US012644209B1

(12) United States Patent
Henrot et al.

(10) Patent No.: US 12,644,209 B1
(45) Date of Patent: Jun. 2, 2026

(54) STRETCHABLE FABRIC ITEMS

(71) Applicant: Apple Inc., Cupertino, CA (US)

(72) Inventors: Camille I Henrot, San Francisco, CA (US); Kristen L Cretella, San Francisco, CA (US); Jessica J Lu, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 208 days.

(21) Appl. No.: 18/335,255

(22) Filed: Jun. 15, 2023

Related U.S. Application Data

(60) Provisional application No. 63/357,928, filed on Jul. 1, 2022.

(51) Int. Cl.
*D04B 21/18* (2006.01)
*A44C 5/00* (2006.01)
*D04B 21/20* (2006.01)

(52) U.S. Cl.
CPC ..... *D04B 21/18* (2013.01); *A44C 5/0053* (2013.01); *D04B 21/205* (2013.01); *D10B 2501/04* (2013.01)

(58) Field of Classification Search
CPC ..... D04B 21/18; D04B 21/205; A44C 5/0053
USPC ..... 224/178
See application file for complete search history.

(56) References Cited

U.S. PATENT DOCUMENTS 943,607 A * 12/1909 Schelling ..... A43C 1/02 24/715.3
2,264,351 A * 12/1941 Willson ..... A61F 9/027 2/452
2,558,007 A * 6/1951 Smith ..... A44C 5/0069 267/74
3,887,968 A * 6/1975 Lynam ..... D04D 9/04 428/101
4,423,539 A * 1/1984 Ivanhoe ..... A43C 1/02 57/259
4,757,926 A * 7/1988 Leo ..... A44C 5/00 224/178
4,905,879 A * 3/1990 Piccone ..... A44C 5/14 224/267
4,945,599 A * 8/1990 Flynn ..... A47L 13/44 15/118
5,781,273 A * 7/1998 Boden ..... G02C 5/10 351/156
5,926,855 A * 7/1999 Brodbeck ..... A63B 33/004 2/11

(Continued)

*Primary Examiner* — Peter N Helvey

(74) *Attorney, Agent, or Firm* — Treyz Law Group, P.C.; Kendall P. Woodruff

(57) ABSTRACT

Items such as wrist straps may include a knit fabric tube or other fabric outer layer having first and second knit fabric portions that form an outer surface of the strap. The knit fabric outer layer may surround an interior cavity having one or more channels. Strands of elastomeric material may be located in the channels. The strands of elastomeric material may each stay within a single channel or may weave back and forth between multiple channels while crossing over adjacent strands of elastomeric material to create points of friction. Some strands of elastomeric material may pass back and forth between the interior cavity of the knit fabric tube and the exterior surface of the strap via an array of openings in the knit fabric tube. Constraint points and points of friction may be used to control stretchability of the strap while reducing elongation over time.

17 Claims, 11 Drawing Sheets

(56) References Cited

U.S. PATENT DOCUMENTS

| | | | | |
|---|---|---|---|---|
| 6,513,210 | B1 * | 2/2003 | Gonzalez | A43C 1/003 24/712 |
| 9,032,763 | B2 | 5/2015 | Meir et al. | |
| 10,758,393 | B2 | 9/2020 | Ingimundarson et al. | |
| 11,230,800 | B2 * | 1/2022 | Cross | A43B 1/04 |
| 2005/0083788 | A1 * | 4/2005 | Ogletree | A44C 5/0069 368/282 |
| 2007/0094768 | A1 * | 5/2007 | Moudgill | A45D 8/36 2/171 |
| 2015/0133014 | A1 | 5/2015 | Traser et al. | |
| 2017/0196303 | A1 | 7/2017 | Davis et al. | |
| 2020/0383449 | A1 * | 12/2020 | Wilczynska | A61N 2/06 |

* cited by examiner

STRETCHABLE FABRIC ITEMS

This application claims the benefit of provisional patent application No. 63/357,928, filed Jul. 1, 2022, which is hereby incorporated by reference herein in its entirety.

FIELD

This relates generally to fabric items and, more particularly, to fabric items for electronic devices.

BACKGROUND

Items such as wristwatches have straps. Straps may be formed from materials such as metal, plastic, and fabric. Fabric wrist straps may be comfortable on the user's skin initially, but may be subject to elongation over time. This elongation can lead to an improper fit on the user's wrist, which in turn can result in inaccurate sensor measurements and user discomfort.

SUMMARY

Items such as electronic devices with straps may include fabric. For example, a strap for a wristwatch may be formed from fabric. Fabric may include strands of material. The strands of material may form a knit fabric tube or other fabric outer layer having first and second knit fabric portions that form an outer surface of the strap.

The knit fabric portions may surround an interior cavity. The interior cavity may have one or more channels extending along the length of the strap. Channel walls may be formed where the first and second knit fabric portions are attached to each other. If desired, some of the channels may merge together into a single channel in regions where the first and second knit fabric portions are detached from one another.

Elastomeric material may be located in the interior cavity of the knit outer layer. The elastomeric material may be a single strip of elastomeric material extending through the interior cavity of the knit fabric tube along the length of the strap. In other arrangements, multiple strands of elastomeric material may be located in the interior cavity. The multiple strands of elastomeric material may be located in a single channel within the knit fabric tube, or the multiple strands of elastomeric material may be located in different respective channels extending along the length of the knit fabric tube.

The strands of elastomeric material may overlap each other, may be braided with each other, and/or may follow other non-straight paths within the interior of the knit fabric tube. Some strands of elastomeric material may follow straight paths within the knit fabric tube while other strands of elastomeric material may follow curved paths within the knit fabric tube. Some of the strands of elastomeric material may pass back and forth between the interior cavity of the knit fabric tube and the exterior surface of the strap via an array of openings in the knit fabric tube.

Constraint points where the strands of elastomeric material are attached to the outer knit fabric portions may be used to control the stretchability of the strap while reducing elongation over time. Points of friction may be created where strands of elastomeric material overlap each other, which can also help control stretchability and reduce elongation.

DETAILED DESCRIPTION

Electronic devices may be provided with fabric. The fabric may be used to form straps or other fabric items for an electronic device. The fabric may have one or more woven fabric portions, one or more knit fabric portions, one or more braided fabric portions, and/or fabric portions formed using other interlacing (intertwining) techniques. The electronic devices may be wristwatches, fitness bands, or other electronic devices. Illustrative configurations in which portable electronic devices such as wristwatch devices or other wrist-mounted portable electronic devices are provided with knit fabric straps may sometimes be described herein as an example. In general, any suitable portable electronic device may be provided with a strap and the strap may be formed from any suitable fabric material. The straps or other fabric structures may be used to attach the portable electronic device to an arm, leg, head, torso, wrist, or other portion of a user's body.

Although sometimes described in the context of straps and electronic devices with straps such as wristwatches, fitness bands, or other electronic devices, the features of strap 16 may be used in other contexts. For example, the fabric and other structures of strap 16 may, if desired, be incorporated into other suitable fabric-based items, clothing items, enclosures (e.g., bags, backpacks, etc.), etc. As examples, the features of strap 16 may be incorporated into clothing, straps for backpacks and other bags, belts, suspenders, straps for clothing, shirts, pants, coats, sweatshirts, sweaters, socks, hats, and other clothing, straps for a head-mounted device, sidewalls and other structures in enclosures such as handbags, satchels, purses, etc., straps and other portions of purses, wallets, covers for electronic devices (e.g., sleeves for tablet computers, cellular telephones, laptop computers, etc.), or any other suitable items having interlaced strands of material.

Figure 1:
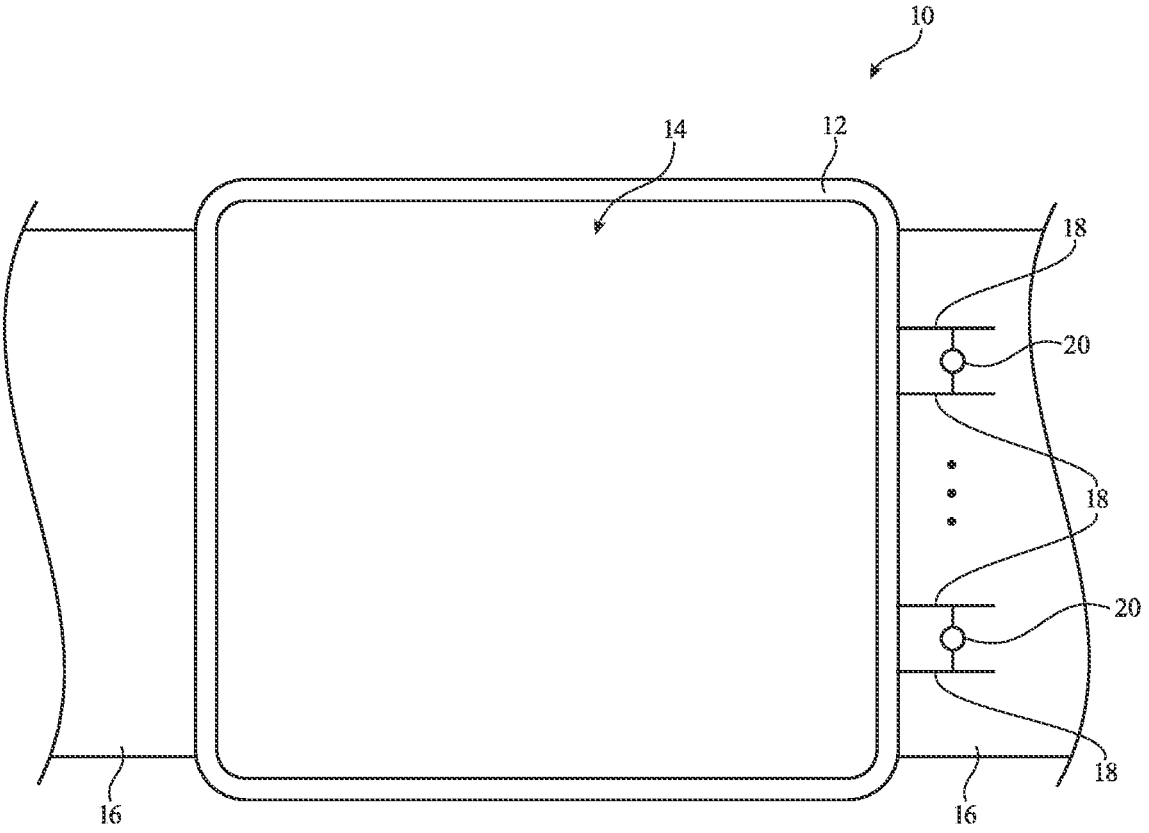
FIG. 1 is a top view of an illustrative electronic device with a fabric strap in accordance with an embodiment.

An illustrative electronic device is shown in FIG. 1. As shown in FIG. 1, device 10 may have a display such as display 14 and other electrical components mounted in a housing such as housing 12. Device 10 may be a portable electronic device such as a device that is mounted on a user's wrist, arm, leg, head, torso, or other body part. Device 10 may, for example, be a wrist-mounted device such as a wristwatch, a health monitoring device, a media player, a wireless key, or other electronic device and/or equipment that includes the functions of two or more of these devices or other suitable devices. Housing 12 (e.g., a watch housing in scenarios in which device 10 is a wristwatch) may be formed from metal, ceramic, plastic, glass, sapphire or other crystalline materials, and/or other suitable materials. Housing 12 may have a rectangular outline, may have an oval or circular shape, or may have other suitable shapes. Display 14 may be a liquid crystal display, an organic light-emitting diode display, or other suitable display.

Strap 16 may have portions attached to opposing sides of housing 12. Strap 16 may be coupled to pins or other structures that are attached to the exterior of housing 12 (as an example). In some arrangements, a clasp formed from hook-and-loop fasteners or other suitable clasp may be used to secure strap 16 about the wrist or other body part of a user. In other arrangements, which are sometimes described herein as an example, strap 16 may be a single piece of fabric without a clasp that fits snugly on the user's wrist by incorporating stretchable materials into strap 16.

Strap 16 may include strands of material that are woven, knit, or otherwise interlaced together. The strands of material that are interlaced to form strap 16 may be monofilaments and/or multifilament yarns. Strap 16 may contain insulating strands of material and/or conductive strands of material. Insulating strands may be formed from dielectric materials such as polymers. Conductive strands may be formed from metal wires or may be formed from one more conductive layers of material such as metal layers on polymer cores or other polymer layers. Conductive strands may also be formed by mixing conductive filaments with insulating filaments. Conductive strands may have insulating coatings.

If desired, strap 16 may contain electrical components such as components 20. Components 20 may include sensors, buttons, light-emitting diodes, batteries, antennas, integrated circuits, vibrators and other actuators, and/or other input-output devices. Conductive strands of material such as conductive strands 18 may be used in routing power and data signals between components 20 within strap 16 and between components such as component 20 in strap 16 and circuitry in housing 12.

Figure 2:
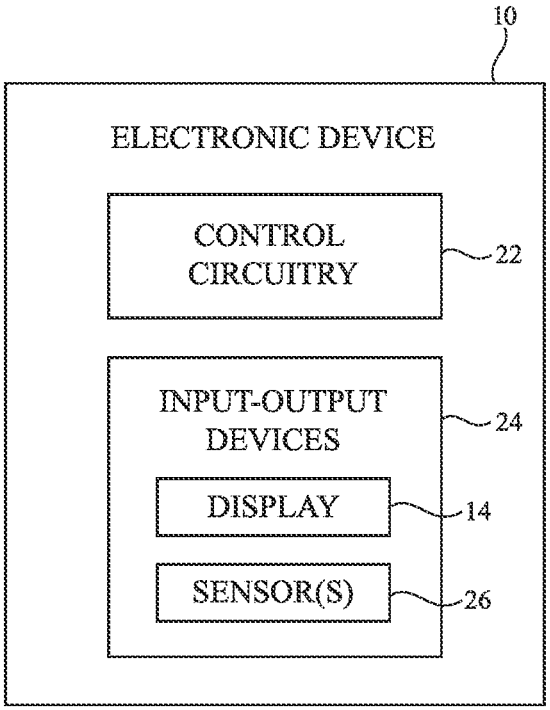
FIG. 2 is a schematic diagram of an illustrative electronic device in accordance with an embodiment.

A schematic diagram of an illustrative electronic device such as device 10 of FIG. 1 is shown in FIG. 2. As shown in FIG. 2, device 10 may include control circuitry 22. Control circuitry 22 may include processing circuitry such as microprocessors, digital signal processors, microcontrollers, baseband processors, image processors, application-specific integrated circuits with processing circuitry, and/or other processing circuitry and may include random-access memory, read-only memory, flash storage, hard disk storage, and/or other storage (e.g., a non-transitory storage media for storing computer instructions for software that runs on control circuitry 22).

Device 10 may include electrical components in housing 12 and/or in strap 16 that form input-output circuitry such as input-output devices 24. Input-output devices 24 may be used to allow data to be supplied to device 10 from external devices and from a user and to allow data to be provided from device 10 to external devices and the user. Input-output devices 24 may include buttons, joysticks, scrolling wheels, touch pads, key pads, keyboards, microphones, speakers, tone generators, vibrators, haptic devices, cameras, light-emitting diodes and other status indicators, displays such as display 14, data ports, etc. Sensors 26 of input-output devices 24 may include touch sensors, force sensors, accelerometers, compasses, magnetic sensors, gas sensors, pressure sensors, temperature sensors, capacitive proximity sensors, light-based proximity sensors, digital image sensors, ambient light sensors, heart rate sensors and blood oxygen sensors (e.g., sensors having a light emitter that emits light into a user's skin and the detects and processes reflected light), and other sensing circuits.

Device 10 may include wireless circuitry (e.g., wireless transceivers, antennas, etc.) for supporting wireless local area network communications, cellular telephone communications, near field communications, wireless power transmission and reception operations, and other wireless communications and power transfer operations.

Figure 3:
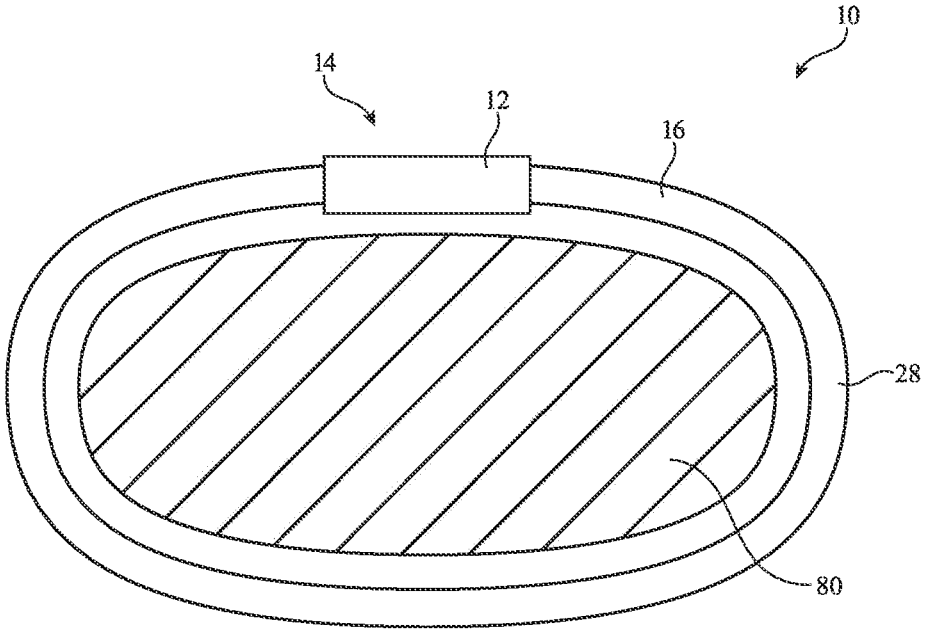
FIG. 3 is a cross-sectional side view of an illustrative electronic device with a wrist strap in accordance with an embodiment.

A cross-sectional side view of an illustrative device such as device 10 of FIG. 1 is shown in FIG. 3. As shown in FIG. 3, strap 16 may have a first end coupled to a first side of housing 12 of device 10 and a second opposing end coupled to a second opposing side of housing 12 of device 10. If desired, strap 16 may have first and second separable strap portions that join together using a clasp (e.g., magnets, hook-and-loop fasteners, interlocking prongs and holes, snaps, or other clasp mechanisms). In other arrangements, strap 16 may be formed from a single piece of fabric 28 that spans continuously between the first end coupled to housing 12 and the second end coupled to housing 12. With this type of arrangement, fabric 28 may be placed around the circumference of the wrist 80 or other body part of a user by stretching strap 16 to fit onto the body of the user.

To allow strap 16 to stretch and fit snugly around the user's wrist, strap 16 may incorporate one or more stretchable materials such as stretchable polyurethane, silicone, elastomeric silicon, and/or other elastomeric materials. Due to the presence of stretchable materials in strap 16, strap 16 may return to its original length after being stretched to fit onto the user's body. This allows a user to stretch strap 16 tightly around wrist 80 or other body part (e.g., to ensure that a satisfactory heart rate monitor signal is picked up by a heart rate monitor in device 10, etc.). If desired, the fabric forming strap 16 may contain non-stretchable strands of material (e.g., polyester, etc.). Non-stretchable strands of material may, for example, be used to provide strap 16 with strength and/or moisture management capabilities.

Figure 4:
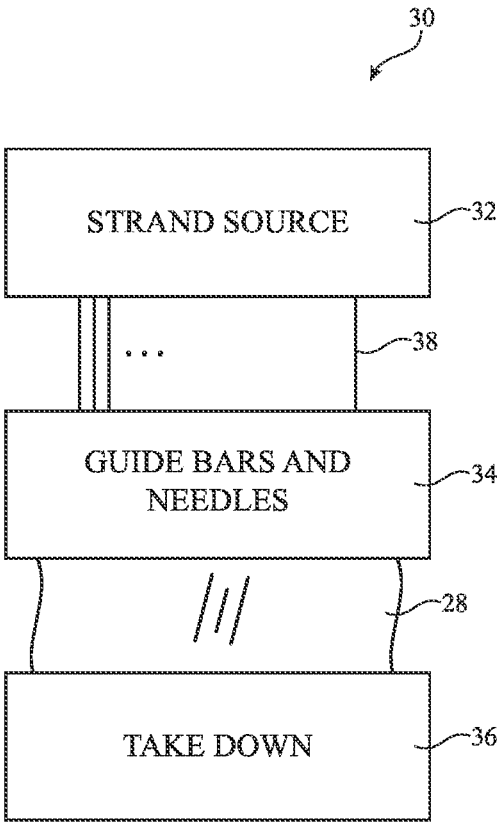
FIG. 4 is a schematic diagram of an illustrative knitting system in accordance with an embodiment.

A knitting machine or other equipment may be used in forming fabric 28. FIG. 4 is a schematic diagram of an illustrative knitting system. As shown in FIG. 4, strand source 32 in knitting system 30 may be used in supplying strands 38 to guide and needle structures 34. Structures 34 may include strand guide structures (e.g., a system of movable guide bars with eyelets that guide strands 38) and needle systems (e.g., needle guide systems that guide sets of individually adjustable needles so that the needles may interact with the strands dispensed by the guide bars). During operations, a controller may control electrically adjustable positioners in system 30 to manipulate the positions of guide bars and needles in system 30 and thereby knit strands 38 into fabric 28. Take down 36 (e.g., a pair of mating rollers or other equipment forming a take down system) may be used to gather fabric 28 that is produced during knitting.

Figure 5:
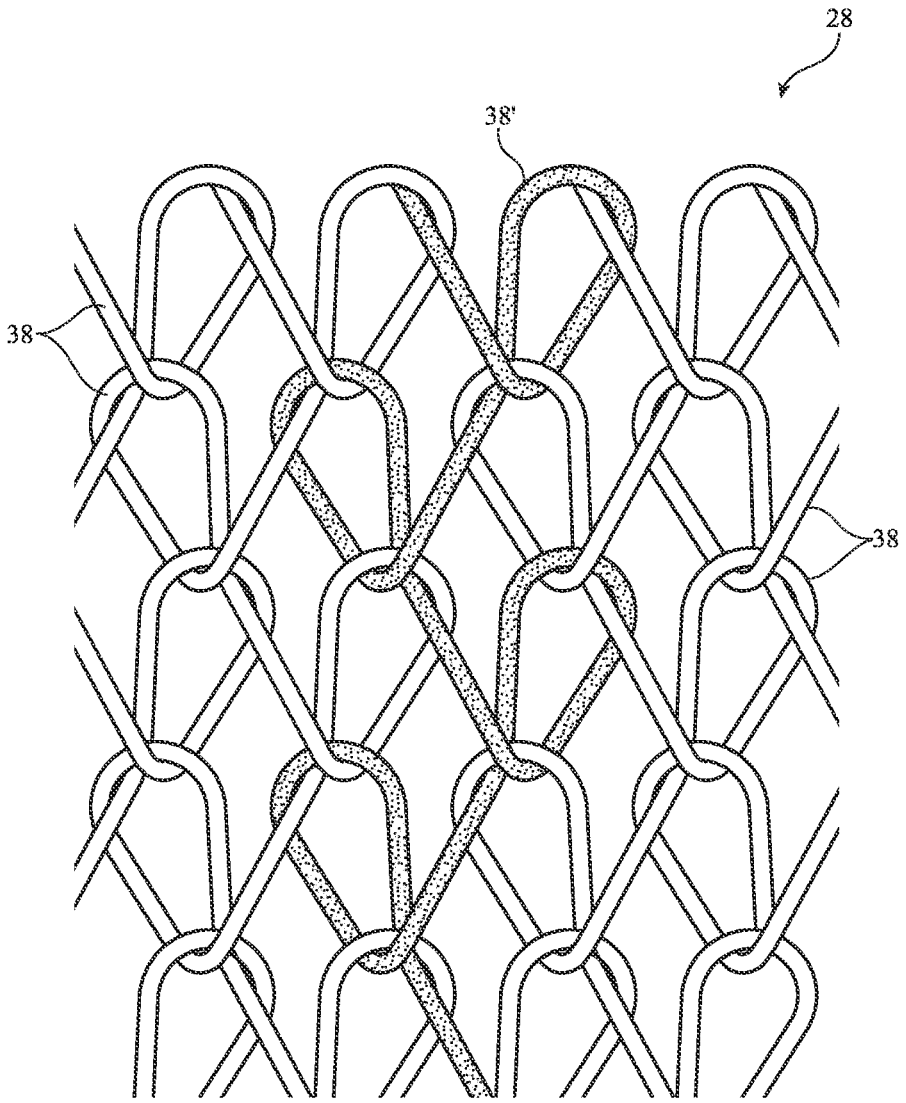
FIG. 5 is a diagram of a portion of an illustrative layer of knit fabric in accordance with an embodiment.

A layer of illustrative warp knit fabric 28 is shown in FIG. 5. An illustrative strand 38' among strands 38 has been highlighted to show the zig-zag path taken by each strand in fabric 28.

The example of FIG. 5 is merely illustrative. Fabric 28 of strap 16 may include warp knit fabric, weft knit fabric, flat knit fabric, circular knit fabric, braided fabric, woven fabric, and/or fabric formed using any other interlacing technique. Arrangements in which fabric 28 of strap 16 is a knit fabric are sometimes described herein as an example.

Figure 6:
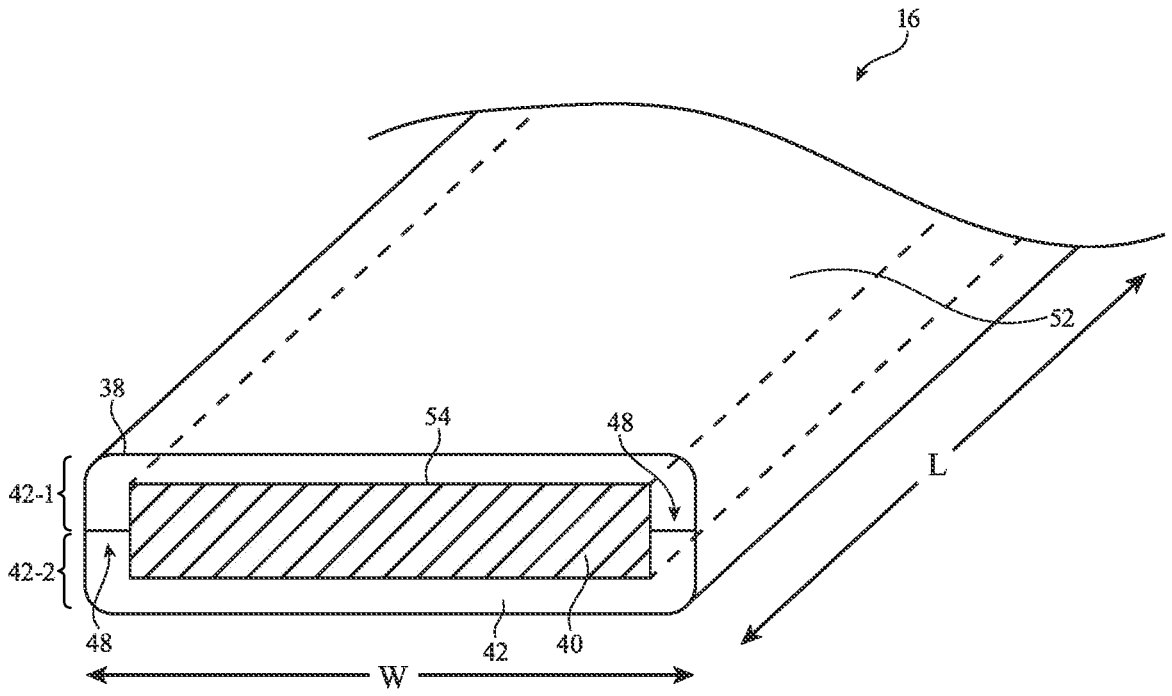
FIG. 6 is a perspective view of an illustrative fabric strap having one or more knit outer layers, an interior cavity that forms a channel, and a strip of elastomeric material extending through the channel in accordance with an embodiment.

If care is not taken, repeated stretching of strap 16 can result in undesired elongation of strap 16 over time. To reduce elongation of strap 16 over time, fabric 28 may incorporate elastomeric materials that help maintain the original unstretched length of strap 16 and reduce elongation over time. FIG. 6 is a perspective view of an illustrative fabric strap incorporating elastomeric material to improve stretchability and reduce elongation over time.

As shown in FIG. 6, strap 16 may include fabric 42. Fabric 42 may be formed from knit fabric (e.g., knit fabric 28 of FIG. 5), cable knit fabric, flat knit fabric, circular knit fabric, bird's eye fabric, woven fabric, braided fabric, and/or other types of fabric. Fabric 42 may include one or more fabric portions such as upper fabric portions 42-1 and lower fabric portion 42-2. Fabric portions 42-1 and 42-2 may be formed from interlaced strands 38 of FIG. 5 or may be formed from strands 38 having other fabric constructions. If desired, a first set of strands 38 may be used to form fabric portion 42-1 and a second set of strands 38 may be used to form fabric portion 42-2. Fabric portions 42-1 and 42-2 may be different portions of a single layer of fabric 42, or fabric portion 42-1 may form one or more first layers of fabric 42 and fabric portion 42-2 may form one or more second layers of fabric 28. Upper and lower fabric portions 42-1 and 42-2 may be knitted as one singular piece of fabric (e.g., a circular knit fabric that forms an elongated fabric tube without seams or stitches) or may be knitted as separate pieces of fabric that are stitched, sewn, or otherwise attached together (e.g., along seams such as seams 48). Fabric 42 may sometimes be referred to as an outer fabric layer, a knit outer fabric layer, a fabric tube, a knit fabric tube, etc.

Using knitting equipment 30, strands 38 may be interlaced to form fabric portions 42-1 and 42-2. In some arrangements, knitting equipment 30 may be used to create one or more interior cavities between fabric portions 42-1 and 42-2 such as channel 54 (sometimes referred to as a tube-shaped channel, an opening, a slot, a groove, a gap, a space, a cavity, a void, a position, a location, etc.) for receiving elastomeric material such as elastomeric material 40. In other arrangements, channel 54 may be formed by selectively attaching two or more pieces of fabric such as fabric portions 42-1 and 42-21 in some regions (e.g., to form channel walls) while leaving other regions detached to form channel 54. Fabric 42 may have the shape of a tube or other shape having a loop-like cross-section surrounding an interior space to form one or more channels such as channel 54.

Elastomeric material 40 (e.g., silicone, elastomeric silicone, polyurethane elastomer, etc.) may be extruded, molded, cut, or otherwise formed into any desired shape (e.g., a cord or tube shape with a circular cross-section, a shape with an oval cross-section, a ribbon or strip shape with a rectangular cross-section, etc.). Elastomeric material 40 may be a single piece of elastomer, a single strand of elastomeric material, a bundle of strands of elastomeric material, a ribbon of elastomeric material, and/or one or more other elastomeric structures for allowing strap 16 to stretch while helping return strap 16 to its original length when strap 16 is in an unstretched state. Elastomeric material 40 may be inserted into channel 54 after fabric portions 42-1 and 42-2 have been knitted. Elastomeric material 40 may sometimes be referred to as inlay elastomer, inlay material, inlay strands, etc.

Channel 54 and elastomeric material 40 may extend along some or all of the length L of strap 16. Elastomeric material 40 may extend continuously along the length of strap 16 or may be segmented to form multiple pieces of elastomeric material 40 along the length of strap 16. Elastomeric material 40 may follow a straight path (e.g., may curve around the wrist but may otherwise extend parallel to the length of strap 16) or may follow a curved, serpentine, zig-zag, or otherwise non-straight path. Similarly, channel 54 may be a straight channel extending parallel to the length L of strap 16, or channel 54 may have one or more turns, curves, or zig-zag portions. Channel 54 may extend continuously along length L or may be segmented or truncated along length L of strap 16. Arrangements in which channel 54 and/or elastomeric material 40 extend perpendicular to the length L or diagonally across width W of strap 16 may also be used.

In the example of FIG. 6, elastomeric material 40 is a strip of elastomeric material having a rectangular cross-section, and strap 16 has a single channel 54 between upper fabric portion 42-1 and lower fabric portion 42-2. Elastomeric material 40 may partially or completely fill the channel between upper fabric portion 42-1 and lower fabric portion 42-2. Elastomeric material 40 may be free to move within channel 54, or elastomeric material 40 may be anchored or otherwise attached to one or more locations of surrounding fabric such as fabric portions 42-1 and 42-2 using adhesive, stitching, welding, crimping, interlocking engagement features, and/or other attachment features.

Figure 7:
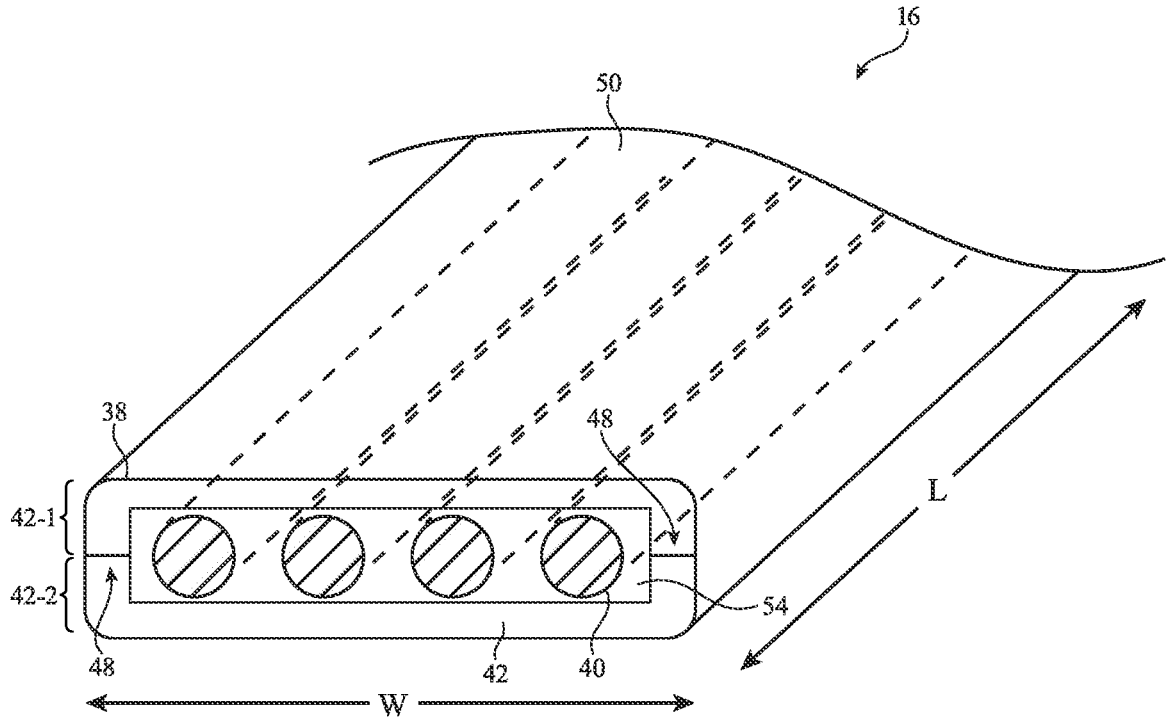
FIG. 7 is a perspective view of an illustrative fabric strap having one or more knit outer layers, an interior cavity that forms a channel, and multiple strands of elastomeric material extending through the channel in accordance with an embodiment.

If desired, multiple elastomeric structures may be incorporated into a single channel. This type of arrangement is illustrated in FIG. 7. As shown in FIG. 7, multiple strands 50 of elastomeric material 40 have been inserted into channel 54 between upper fabric portion 42-1 and lower fabric portion 42-2. Strands 50 may be formed of the same or different material as one another, may have the same or different diameters as one another, and/or may have the same or different cross-sectional shape as one another. Strands 50 may be strip-shaped strands (e.g., having rectangular cross-sections), may be tube-shaped strands (e.g., having circular, oval, or other round-shaped cross-sections), or may have any other suitable shape. There may be one, two, three, four, five, ten, more than ten, or less than ten strands 50 of elastomeric material 40 within channel 54. Strands 50 and channel 54 may follow straight paths, curved paths, paths that extend parallel to and/or perpendicular to length L, diagonal paths that extend diagonally across the width W of strap 16, and/or any other suitable path within strap 16. Strands 50 may extend continuously along the length L of strap 50, may be segmented along the length L of strap 50, and/or may only be located in certain portions of strap 16. Strands 50 may be parallel to one another, may have crossover points where strands 50 cross over one another, and/or may be braided, twisted, or otherwise intertwined with one another.

Figure 8:
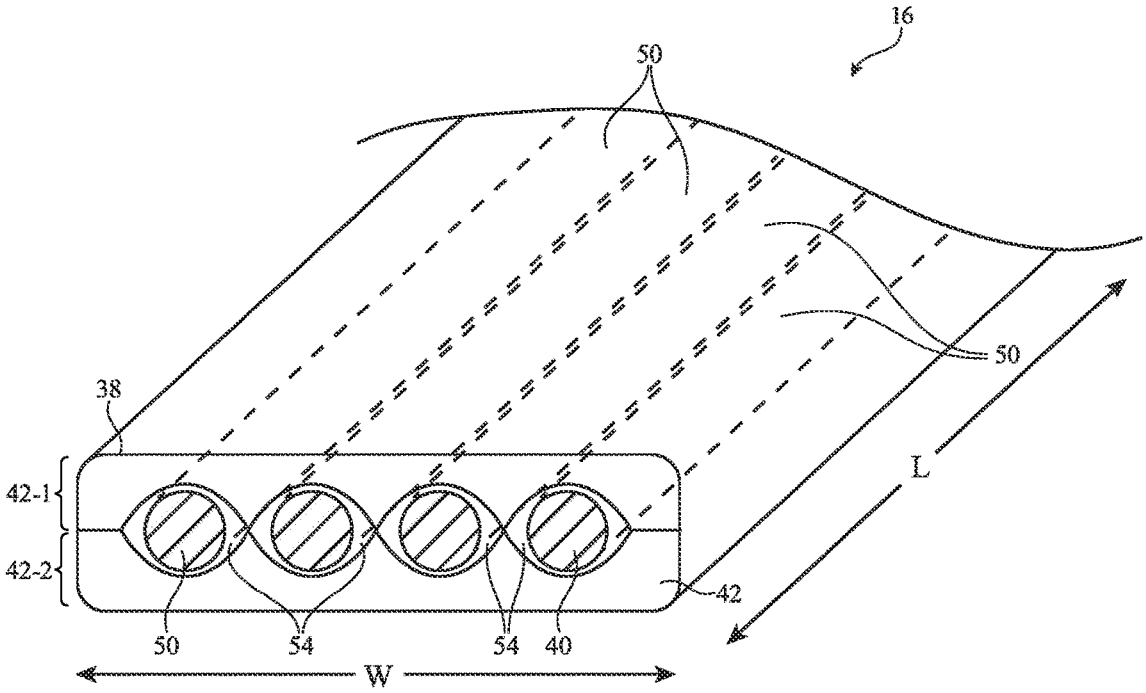
FIG. 8 is a perspective view of an illustrative fabric strap having one or more knit outer layers, an interior cavity with multiple channels, and strands of elastomeric material extending through the respective channels in accordance with an embodiment.

If desired, multiple channels may be formed within strap 16. This type of arrangement is illustrated in FIG. 8. As shown in FIG. 8, strap 16 may have multiple channels 54 (e.g., tube-shaped channels) extending along length L of strap 16. Channels 54 may be formed by selectively attaching portions of upper fabric portion 42-1 to lower fabric portion 42-2, thereby breaking up the hollow interior of fabric tube 42 into multiple channels with walls formed by fabric 42. In other arrangements, a separate structure such as an elongated metal or plastic rod or strip may be inserted between fabric portions 42-1 and 42-2 to form channel walls that break up the interior of fabric tube 42 into multiple individual channels 54.

Channels 54 may extend continuously along length L of strap 16, may be segmented, or may only be located in certain portions of strap 16. Each channel 54 may receive one or more strands 50 of elastomeric material 40. In the example of FIG. 8, each channel 54 has a single strand 50 of elastomeric material 40. In other arrangements, each channel 54 may have multiple strands 50 of elastomeric material 40 (e.g., two, three, four, five, more than five, more than ten, or less than ten strands 50 of elastomeric material 40.

Strands 50 may be formed of the same or different material as one another, may have the same or different diameters as one another, and/or may have the same or different cross-sectional shape as one another. Strands 50 may be strip-shaped strands (e.g., having rectangular cross-sections), may be tube-shaped strands (e.g., having circular, oval, or other round-shaped cross-sections), or may have any other suitable shape. Strands 50 and channels 54 may follow straight paths, curved paths, paths that extend parallel to and/or perpendicular to length L, diagonal paths that extend diagonally across the width W of strap 16, and/or any other suitable path within strap 16. Strands 50 may extend continuously along the length L of strap 50, may be segmented along the length L of strap 50, and/or may only located in certain portions of strap 16. Strands 50 may be parallel to one another, may have crossover points where strands 50 cross over one another, and/or may be braided, twisted, or otherwise intertwined with one another.

Figure 9:
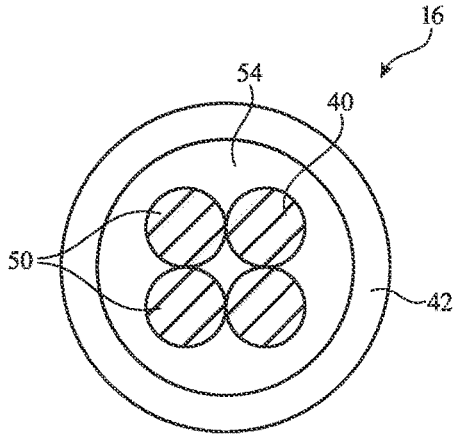
FIG. 9 is a cross-sectional side view of an illustrative portion of a fabric strap in which multiple strands of elastomeric material extend through a channel within the interior cavity of a knit fabric outer layer in accordance with an embodiment.

FIG. 9 is a cross-sectional side view of an illustrative portion of strap 16 showing how strands 50 of elastomeric material may be formed without a sheath. In other words, raw or bare elastomeric material 40 may be exposed to the outer walls of channel 54 formed by knit fabric 42. There may be one, two, three, four, more than four, more than ten, or less than ten strands 50 of elastomeric material 40 within channel 54. Because no sheath is present, strands 50 may be contained by the walls of channel 54 formed by knit fabric 42.

Figure 10:
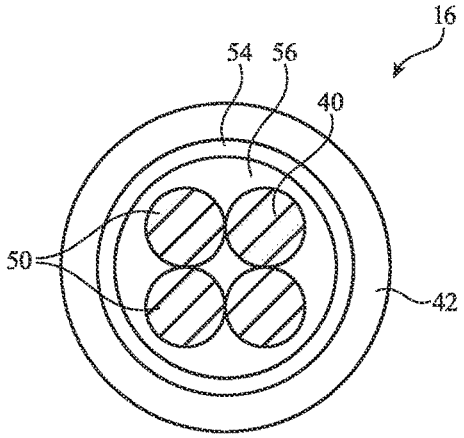
FIG. 10 is a cross-sectional side view of an illustrative portion of a fabric strap in which a cord carrying multiple strands of elastomeric material extends through a channel within the interior cavity of a knit fabric outer layer in accordance with an embodiment.

In the example of FIG. 10, a sheath such as sheath 56 forms an outer covering around one or more core strands 50 of elastomeric material 40. There may be one, two, three, four, more than four, more than ten, or less than ten core strands 50 of elastomeric material 40 at the core within sheath 56. Sheath 56 may be formed from an elastic or non-elastic material (e.g., polyester). Sheath 56 may be formed from strands of material that are braided, twisted, or otherwise wrapped around the core formed from one or more core strands 50 of elastomeric material 40. This type of strand may sometimes be referred to as paracord. In other arrangements, sheath 56 may be a coating, a hollow tube, or other covering structure for containing strands 50 within sheath 56. Each channel 54 may have one, two, three, more than five, more than ten, or less than ten sheaths 56, each containing any suitable number of individual core strands 50 of elastomeric material 40.

Figure 11:
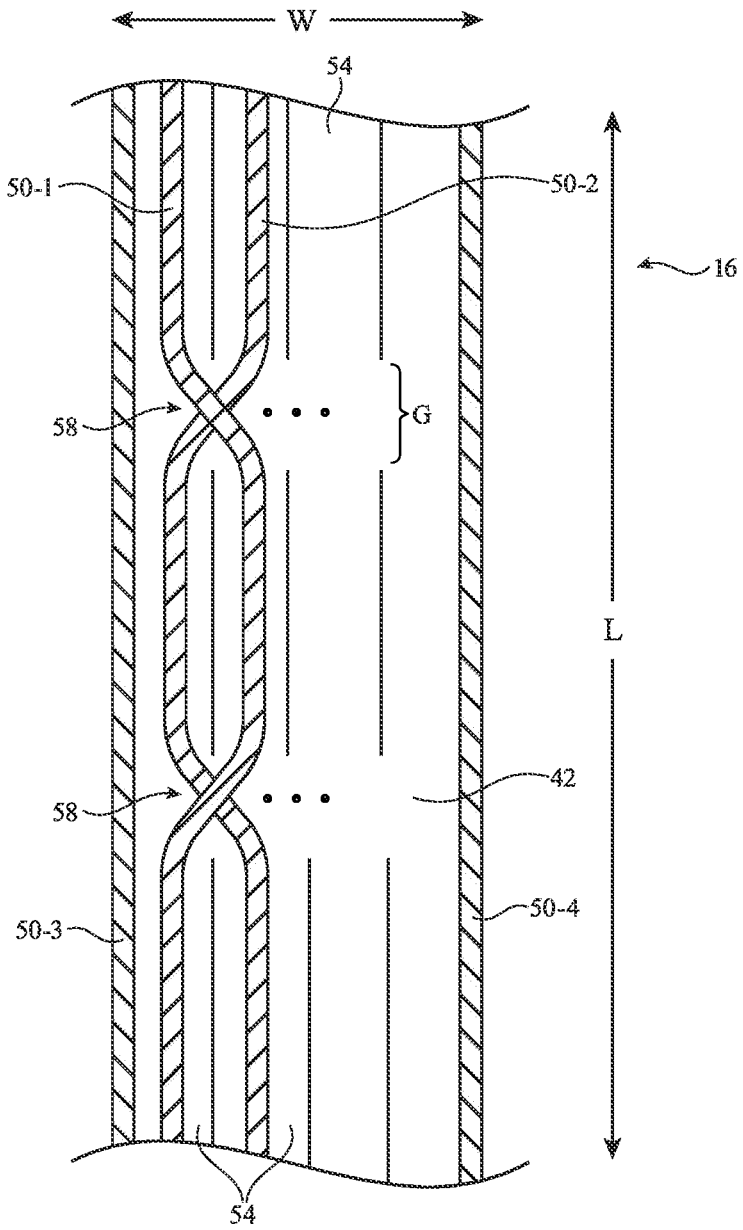
FIG. 11 is a top view of an illustrative fabric strap having strands of elastomeric material extending through channels in the fabric strap and forming crossover points to reduce elongation over time in accordance with an embodiment.

FIG. 11 is a top view showing how channels within knit fabric 42 of strap 16 may merge at one or more locations to allow crossover points between adjacent strands 50 of elastomeric material 40. As shown in FIG. 11, channels 50 may have one or more gaps such as gaps G. In regions where gaps G are located, upper fabric portion 42-1 may be decoupled (detached) from lower fabric portion 42-1 so that one or more channels 54 can merge. This allows strands 50 to cross over with other strands 50 to form a point of friction, which in turn can help anchor strands 50 within strap 16 and reduce undesired elongation.

In the example of FIG. 11, strands 50 include braided strands 50-1 and 50-2, which are separated from one another in adjacent channels 54 but that cross over each other periodically in gaps G to form points of friction at crossover points 58. Strand 50-1 and strand 50-2 may each switch back and forth between two adjacent channels 54 (e.g., strand 50-1 extends through a first channel 54, crosses over to an adjacent channel at gap G, extends through the adjacent channel, crosses back over to the first channel at the next gap G, while strand 50-2 mirrors this same pattern in an alternating fashion).

The pattern of FIG. 11 is merely illustrative. Strands 50 may cross over multiple channels 54 (e.g., meandering back and forth between a first and third channel and skipping a second channel between the two, etc.), may include straight strands 50 that stay in the same channel 54 as well as strands 50 that pass through multiple channels 54, etc. Edge channels 54 may receive strands 50 of different diameter or material than the interior channels 54, if desired. For example, strand 50-3 and strand 50-4 may be received within edge channels 54 along first and second opposing edges of strap 16. Strands 50-3 and 50-4 may have a larger diameter than strands 50 in the interior channels 54 such as strands 50-1 and 50-2 (if desired).

Figure 12:
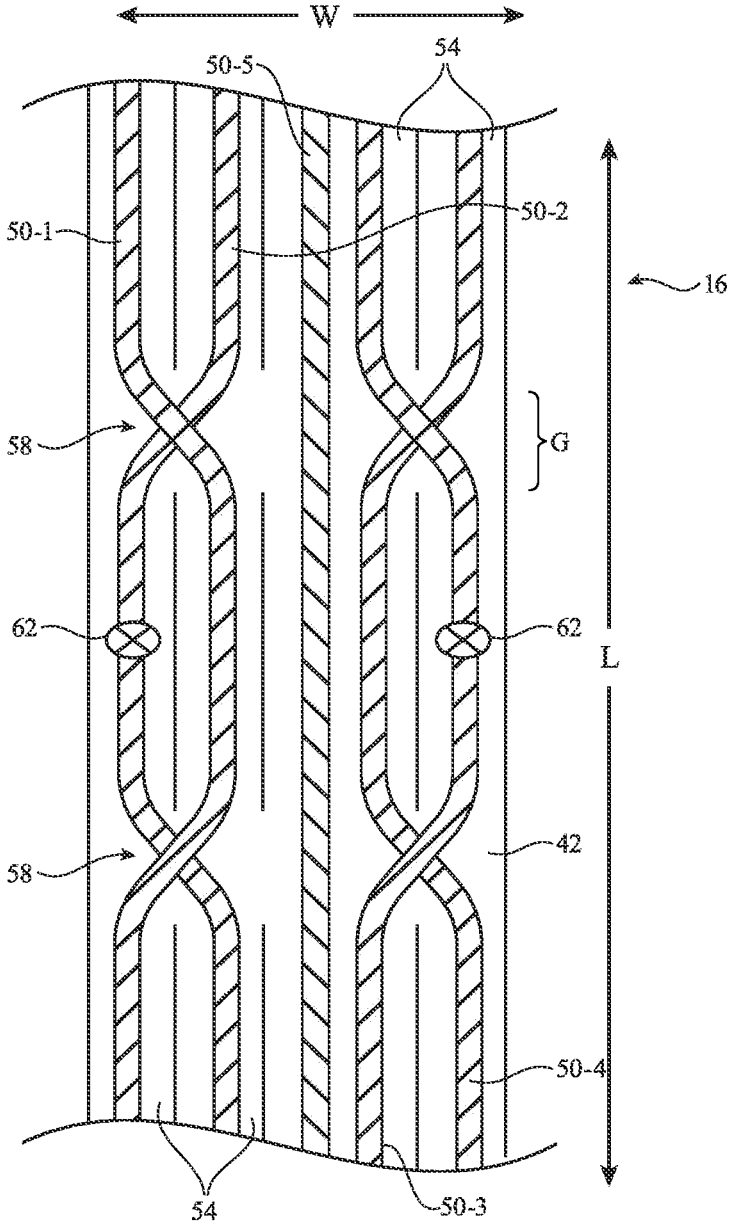
FIG. 12 is a top view of an illustrative fabric strap having strands of elastomeric material extending through channels in the fabric strap and having constraint points to reduce elongation over time in accordance with an embodiment.

FIG. 12 shows an illustrative arrangement in which strands 50 are constrained at one or more locations along the length of strap L. As shown in FIG. 12, strap 16 may include multiple channels 54 with gaps G to allow strands 50 to cross over to different channels 54. Some strands such as strands 50-1, 50-2, 50-3, and 50-4 may meander back and forth between two or more channels 54 of strap 16. The locations where strands 50 overlap one another may form crossover points 58 with increased friction. Other strands such as strands 50-5 (e.g., a strand along the center of strap 16, along one or more edges of strap 16, and/or at any other suitable location within strap 16) may remain within a single channel and may follow a straight path, if desired.

To control the stretching of strap 16, constraint points such as constraint points 62 may be formed at one or more locations along strands 50. Constraint points 62 may be locations where strand 50 is anchored to the surrounding knit fabric 42. For example, constraint points 62 may include stitches, adhesive, welds, crimping, interlocking engagement features, and/or other attachment structures that can help constrain movement of strand 50. Constraint points 62 may, for example, be formed from strands of knit fabric 42 that wrap around or otherwise couple to strands 50 in channels 54. Some or all of strands 50 may be provided with constraint points 62. There may be one, two, three, more than five, or less than five constraint points 62 along the length of a given one of strands 50.

Figure 13:
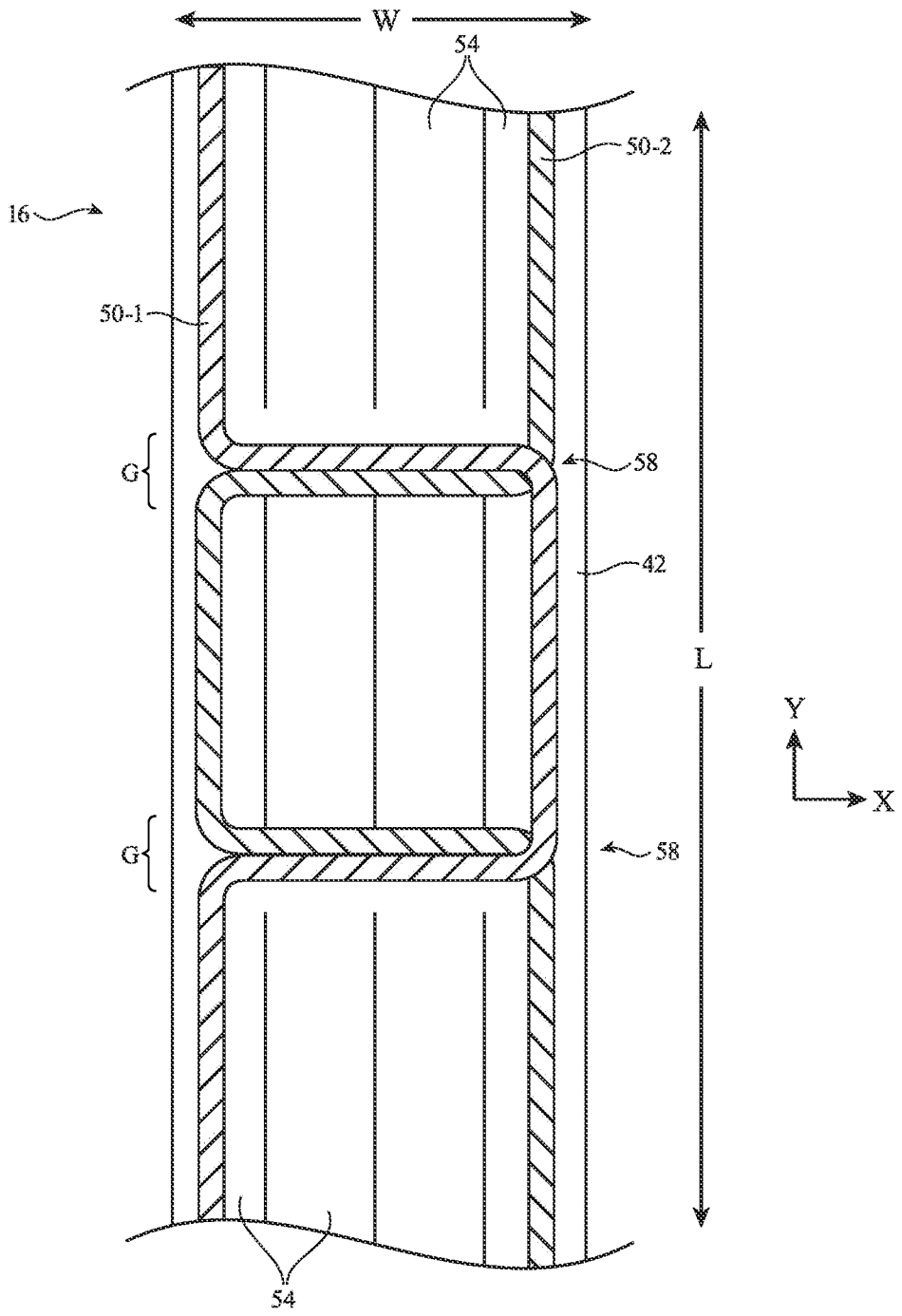
FIG. 13 is a top view of an illustrative fabric strap having strands of elastomeric material extending through vertical and horizontal channels in the fabric strap to reduce elongation over time in accordance with an embodiment.

FIG. 13 shows an example in which strands 50 extend through orthogonal channels within strap 16. As shown in FIG. 13, channels 54 extend in the y-direction along the length L of strap 16. Gaps G may be formed in channels 54 to form additional channels extending in the x-direction of FIG. 13. Strands 50 may have some segments extending in channels 54 along the y-direction and other segments extending in the channels formed by gaps G along the x-direction. This helps form elongated crossover points 58 where strands 50 can overlap each other over a larger surface area to create additional friction that helps control the stretching of strap 16. As shown in FIG. 13, for example, strand 50-1 may extend in the y-direction through a first channel, may extend in the x-direction through a channel formed from gap G, skipping over second and third channels, and may extend in the y-direction through a fourth channel before crossing back over to the first channel. Strand 50-2 may follow a similar path in an alternating pattern, crossing over strand 50-1 along each x-direction channel formed by gaps G. The pattern of FIG. 13 is merely illustrative. Strands 50 may cross over more than two channels (e.g., three, four, or more than four channels), may include straight strands 50 that stay in the same channel 54 as well as strands 50 that pass through multiple channels 54, etc.

Figure 14:
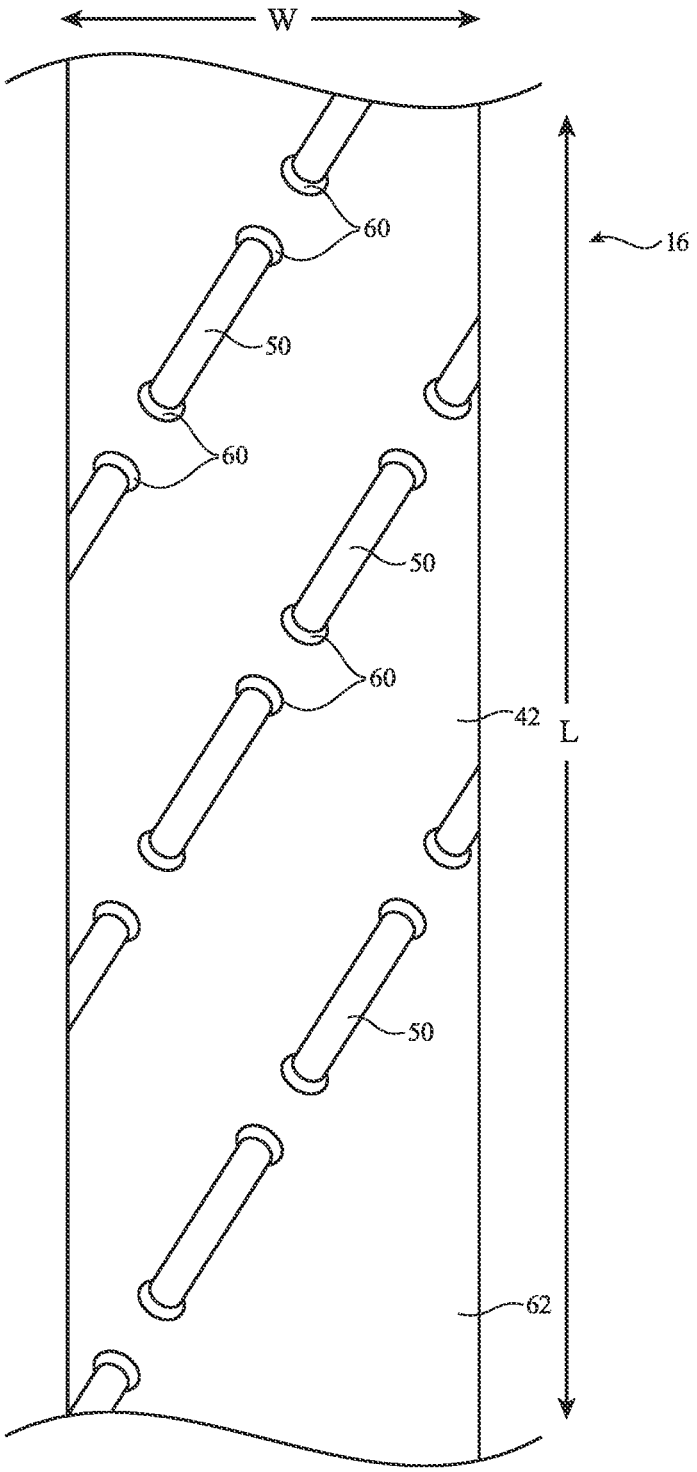
FIG. 14 is a top view of an illustrative fabric strap having strands of elastomeric material that float over an outer surface of the fabric strap in accordance with an embodiment.

In the example of FIG. 14, strands 50 may pass between interior and exterior portions of knit fabric 42 via one or more openings. As shown in FIG. 14, knit fabric 42 may have one or more openings such as openings 60. Openings 60 may be mesh holes, cutaway portions, or regions with a greater spacing between the strands that form fabric 42. Instead of or in addition to inserting strands 50 of elastomeric material 40 into channels that are contained entirely within the interior cavity of fabric 42, strands 50 may pass through openings 60 so that portions of strands 50 are exposed on an outer surface of strap 16. Strands 50 may pass back and forth between the interior cavity of strap 16 (e.g., the interior cavity surrounded by fabric tube 42) and the exterior surface of strap 16 (e.g., formed by the outer surface of fabric 42) through openings 60, thereby forming a desired pattern on the surface of strap 16 while also helping anchor strand 50 along the length of strap 16 to control stretch. In the example of FIG. 15, strands 50 extend diagonally across the width W of strap 16, but this is merely illustrative. Strands 50 may extend parallel to the length L of strap 16, may extend parallel to width W of strap 16, may form curved or meandering paths along strap 16, and/or may have any other suitable pattern. Strands 50 that pass through openings 60 and are exposed on the surface of strap 16 may be separate from the strands 50 that pass through channels 54, or the same strands that pass through channels 54 may also have one or more portions that extend through openings 60 and onto the outer exposed surface of strap 16. Strands 50 that are exposed on the surface of strap 16 may have a different color than the surrounding fabric 42 to form a contrasting pattern, or the same color may be used so that strands 50 blend in with the surrounding fabric 42.

The foregoing is merely illustrative and various modifications can be made to the described embodiments. The foregoing embodiments may be implemented individually or in any combination.

What is claimed is:

1. A fabric wrist strap, comprising:
a knit fabric tube having first and second knit fabric portions that extend along a length;
a channel within the knit fabric tube extending at least partially along the length of the knit fabric tube, wherein the channel is one of multiple channels within the knit fabric tube and wherein the multiple channels are separated from one another by portions of the knit fabric tube in which the first knit fabric portion is attached to the second knit fabric portion; and
an elastomeric material located in the channel that is configured to stretch along the length of the knit fabric tube.

2. The fabric wrist strap defined in claim 1 wherein the elastomeric material comprises strands of elastomeric material that are respectively located in the multiple channels.

3. The fabric wrist strap defined in claim 2 wherein the multiple channels include first and second channels that merge at a given location along the length of the knit fabric tube.

4. The fabric wrist strap defined in claim 3 wherein the strands of elastomeric material include first and second strands of elastomeric material respectively located in the first and second channels and wherein the first and second strands of elastomeric material cross over each other at the given location where the first and second channels merge.

5. The fabric wrist strap defined in claim 4 wherein the multiple channels include a third channel located along an edge of the fabric wrist strap and the strands of elastomeric material include a third strand of elastomeric material located in the third channel.

6. The fabric wrist strap defined in claim 5 wherein the third strand of elastomeric material has a different diameter than the first and second strands of elastomeric material.

7. The fabric wrist strap defined in claim 1 wherein the elastomeric material is attached to the knit fabric tube at given location along the length to constrain movement of the elastomeric material relative to the knit fabric tube.

8. The fabric wrist strap defined in claim 1 wherein the elastomeric material comprises a flat strip of elastomeric material having a rectangular cross-section.

9. A fabric strap, comprising:
a first knit fabric portion;
a second knit fabric portion;
tube-shaped channels extending between the first and second knit fabric portions; and
strands of elastomeric material located in the tube-shaped channels, wherein the first knit fabric portion is attached to the second knit fabric portion in locations between the tube-shaped channels.

10. The fabric strap defined in claim 9 wherein the tube-shaped channels merge at a given location along a length of the fabric strap.

11. The fabric strap defined in claim 10 wherein the strands of elastomeric material include first and second strands of elastomeric material that overlap each other at the given location wherein the tube-shaped channels merge.

12. The fabric strap defined in claim 11 wherein the first and second knit fabric portions are attached to one another to form walls of the tube-shaped channels and are detached from one another to form gaps between the first and second knit fabric portions where the tube-shaped channels merge.

13. The fabric strap defined in claim 9 wherein the tube-shaped channels include at least first and second tube-shaped channels, wherein the strands of elastomeric material comprise first and second strands of elastomeric material, wherein the first strand of elastomeric material meanders back and forth between the first and second tube-shaped channels and the second strand of elastomeric material meanders back and forth between the second and first tube-shaped channels in an alternating pattern with the first strand of elastomeric material.

14. A fabric band, comprising:

a knit fabric tube having first and second knit fabric portions that surround an interior cavity and that form an exterior surface of the fabric band, wherein the knit fabric tube has an array of openings and wherein the interior cavity has tube-shaped channels that are separated from one another by portions of the knit fabric tube in which the first knit fabric portion is attached to the second knit fabric portion; and strands of elastomeric material in the tube-shaped channels that pass back and forth between the interior cavity and the exterior surface of the fabric band through the openings, wherein the strands of elastomeric material are configured to stretch along a length of the knit fabric tube.

15. The fabric band defined in claim 14 wherein the strands of elastomeric material each comprise a sheath surrounding a core of elastomeric material.

16. The fabric band defined in claim 15 wherein the core comprises multiple core strands within the sheath.

17. The fabric band defined in claim 14 wherein the openings comprise first and second openings and wherein a given one of the strands of elastomeric material passes from the interior cavity to the exterior surface through the first opening and passes from the exterior surface to the interior cavity through the second opening.

* * * * *